US009114444B1

(12) United States Patent
Lam

(10) Patent No.: US 9,114,444 B1
(45) Date of Patent: Aug. 25, 2015

(54) ROBUST AIR CLEANING SYSTEM IN MANICURE WORKSTATION

(71) Applicant: Hung Lam, Mobile, AL (US)

(72) Inventor: Hung Lam, Mobile, AL (US)

( * ) Notice: Subject to any disclaimer, the term of this patent is extended or adjusted under 35 U.S.C. 154(b) by 39 days.

(21) Appl. No.: 14/082,109

(22) Filed: Nov. 16, 2013

(51) Int. Cl.
*B08B 15/00* (2006.01)
*A45D 29/00* (2006.01)

(52) U.S. Cl.
CPC ..... *B08B 15/00* (2013.01); *A45D 29/00* (2013.01)

(58) Field of Classification Search
CPC ..... B01D 46/00; B01D 46/04; A45D 29/00; B08B 15/00; B08B 15/04; B08B 2215/006
USPC ..... 55/385.2, 417, 467, 473, DIG. 18; 454/56, 62, 63, 67, 57, 66, 49; 132/73, 132/73.5, 200, 286
See application file for complete search history.

(56) References Cited

U.S. PATENT DOCUMENTS

| | | | | |
|---|---|---|---|---|
| 3,630,005 | A * | 12/1971 | Reinauer | 55/302 |
| 4,280,519 | A | 7/1981 | Chapman | |
| D325,431 | S | 4/1992 | Novobilski | |
| 5,112,373 | A | 5/1992 | Pham | |
| 5,735,918 | A * | 4/1998 | Barradas | 96/222 |
| 5,787,903 | A | 8/1998 | Blackshear | |
| 5,816,906 | A | 10/1998 | Mai | |
| 6,116,249 | A * | 9/2000 | Tuffery | 132/200 |
| 6,444,002 | B1 * | 9/2002 | Mai | 55/385.1 |
| 6,698,360 | B2 | 3/2004 | Park | |
| 6,708,697 | B1 | 3/2004 | Ziff | |
| 8,430,940 | B2 * | 4/2013 | Nguyen | 55/385.2 |
| 2008/0216647 | A1 | 9/2008 | Phan | |
| 2010/0089235 | A1 * | 4/2010 | Foerster | 95/90 |

* cited by examiner

*Primary Examiner* — Duane Smith
*Assistant Examiner* — Minh-Chau Pham
(74) *Attorney, Agent, or Firm* — Kyle W. Rost

(57) ABSTRACT

A manicure table provides a ventilated and filtered venue for removing debris and odor that are generated in the manicuring process. The manicure table employs table geometry to establish optimally low air flow through functional components that remove debris and odor.

11 Claims, 5 Drawing Sheets

ROBUST AIR CLEANING SYSTEM IN MANICURE WORKSTATION

BACKGROUND OF THE INVENTION

1. Field of the Invention

The invention generally relates to horizontally supported planar surfaces with air moving means. More specifically, the invention relates to a nail device or workstation for performing manicure.

2. Description of Related Art Including Information Disclosed Under 37 CFR 1.97 and 1.98

Professional manicure salons increasingly protect both employees and customers from exposure to manicure by-products. Successful control of by-products requires that both solids and vapors be removed from the work area. The solids range from nail clippings to nail filings and may include abrasive particles from smoothing tools. The vapors are largely evaporated solvents and thinners in products used for manicure and in polish. These products might be nail polish remover, nail polish, adhesives, and other types of cleaners, finishes, lotions, and the like.

These by-products commonly escape when manicures are performed. In a home setting, they produce little difficulty because the quantity of manicures performed at one time is small. However, in a professional salon there may be a considerable number of manicures performed at the same time, both preceded and followed by additional manicures. Thus, by-products in a salon are generated almost continuously throughout the day and are a substantial problem to adequately remove from the nail salon, due to the high volume of solvents that enter the air from multiple workstations.

Exhaust systems have been used to vent solvents, where allowed by air quality regulations. However, an exhaust system merely transfers the solvents to the outside environment, where the solvent accumulates with other undesirable vapors to lower the general quality of ambient air. Exhaust systems present the further problem of requiring make-up air flow into the salon, which brings in untreated outside air. The heating or cooling system in the salon is required to treat this constant flow of new air, which can add considerable cost to operating the business.

Closed loop treatment systems attempt to avoid loss of treated air. Some of these are small or portable blower systems that purport to clean the air, but experience shows that these lack functional capacity, apparently due to their small size and inability to handle the volume of solvents that single workstation can generate over a single day. These small systems are not integrated with the manicure workstation and appear to interfere with or restrict the manicurist's work. Examples are a table-top unit disclosed in U.S. Design Pat. D325,431 to Novobilski; and a tripod mounted vacuum disclosed in U.S. Pat. No. 6,116,249 to Tuffery. U.S. Pat. No. 6,698,360 to Park is similar in showing a taxi unit that is placed on a workstation and neighboring floor. The taxi unit has air purifier placed in open view next to a workstation, with a vacuum hose draped over the workstation and leading to a suction head standing upon the workstation.

Another style of blowers or filters is the hood-mounted system, disclosed in basic form in U.S. Pat. No. 5,816,906 to Mai and U.S. Pat. No. 5,112,373 to Pham. The presence of a hood is a significant inhibitor to the close attention that accompanies good quality manicure work, and the presence of a laboratory-style hood can discourage and drive away customers. At the same time, a hood can be carried to further negative extremes. This is seen in U.S. Pat. No. 6,708,697 to Ziff, which converts the hood into a full sealing sleeve and cuff box, which is alarmingly reminiscent of highly dangerous situations involving disease, poison, or radioactivity. To a similar degree, U.S. Pat. No. 5,787,903 to Blackshear discloses a hood box that modifies the arm sleeves to be entry seals or slots on each side of the hood. Understandably, almost no manicurist would be willing to use such extreme equipment.

A workstation as shown in U.S. Patent Publication 2008/0216647 to Phan conceals much of the technical equipment within the workstation. However, Phan merely shelters the equipment from view without achieving the advantages of integrating the equipment into existing structures of the workstation. For example, one pedestal of Phan's workstation merely hides inside it a pre-existing vacuum cleaner. Likewise, U.S. Pat. No. 4,280,519 to Chapman shows an exhaust system that does not utilize the structures of the manicure table to optimize performance of the various stages of the cleaning process.

Portable systems and hoods all are undesirable for negatively impacting on customers and on the manicurist trade. The clearest problem is the visual impact or fear factor caused by technical equipment on display. Manicurists strive to make their shops warm and inviting, rather than cold and technical. It would be desirable for a manicure workstation to minimize or eliminate signs of technical equipment in use. While the use of air cleaning equipment is environmentally helpful, the equipment should take advantage of existing support structure in the manicure salon to operate optimally with minimum imposition on the manicurist and customer.

It would be desirable to have a robust cleaning system in a manicure table, employing table geometry to create high efficiency in debris and odor removal.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide apparatus and method for controlling and reducing the level of by-products in the setting of a professional manicure salon. More specifically, a manicure table employs pre-existing or typical table geometry to achieve high efficiency removal and processing of debris and odor.

According to the invention, a manicure table employs table geometry to create high efficiency in debris and odor removal. The table may be of pre-existing or typical design in which it is formed of a substantially vertical support pedestal and a substantially horizontal manicure work surface that is offset from over-pedestal position. An integrated, robust air cleaning system operates on air flowing in a flow path through the following elements in series: an air inlet grid located on the manicure work surface; a collection chamber located below the air inlet grid; an air duct having an inlet end and a discharge end, where the inlet end communicates with the collection chamber and includes a shank portion that leads laterally from the collection chamber into the pedestal; a separation wall positioned across the pedestal, below the shank portion of the air duct, and providing a passage through which the discharge end of the air duct communicates with the area of the pedestal below the separation wall; a particle collector bag that is located in the pedestal, and is attachable to an outlet end of the air duct below the separation wall to receive air flow and to pass the flow through the particle collector bag, and in which the particle collector bag is suspendable from the separation wall at the periphery of the passage when attached to the outlet end of the air duct; a vertical support and bag spreader below the particle collector bag, in use carrying and widening the collector bag in the pedestal; a vacuum equalization chamber located in the pedestal below the bag spreader; a filter bed of odor removing media located in the pedestal below the vacuum equalization chamber and substantially extending to the sides of the pedestal; an air seal between the sides of the filter bed and the sides of the pedestal; and an exhaust blower located below the filter bed, receiving filtered air flow through the filter bed and exhausting the air flow through an exhaust grid in a pedestal side wall. The flow path is contoured with relative cross-sectional areas to establish, in use, relatively high air flow velocity through the duct to produce a high rate of debris removal from the collection chamber and to establish relatively low air flow velocity through the particle collector bag and filter bed to produce high removal rate of particles and odors in these elements. The contours achieve velocity in the duct is at least five times velocity at the inlet grid, and velocity through the particle collector bag and filter bed is less than one-half of the air flow velocity through the air inlet grid.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

The invention is an apparatus and method for cleaning air at a manicure workstation, wherein the manicure table employs table geometry to create high efficiency in debris and odor removal. The manicure table or workstation provides a ventilated and filtered venue for removing debris and odor that are generated in the manicuring process. The workstation is of primary value in a professional setting such as a nail care shop, where fumes and debris can accumulate. The invention provides a robust cleaning system for removing debris, toxins, and odor from ambient air and returning the cleaned air to the interior of the shop. The invention is particularly suited for use with a manicure table configured with a substantially vertical support pedestal and a substantially horizontal manicure work surface that is offset from over-pedestal position.

Figure 1:
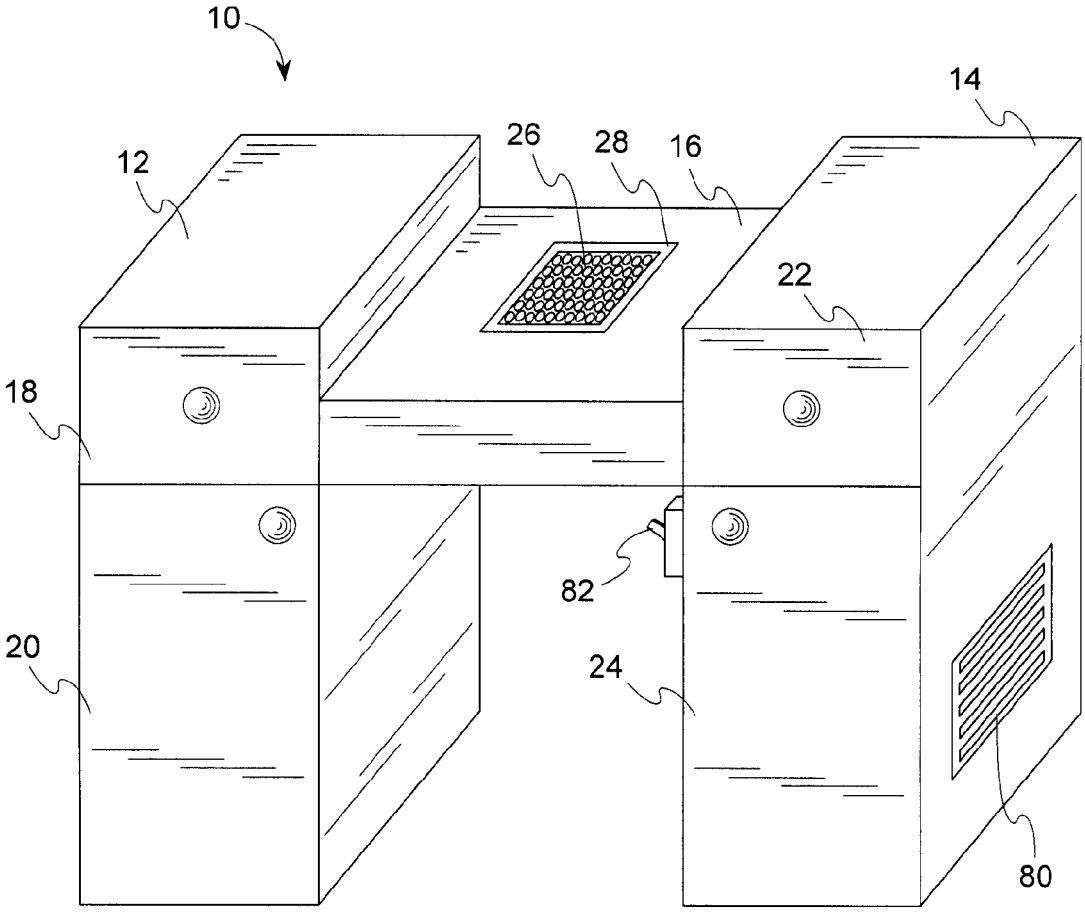
FIG. 1 is a top left isometric view of a two-pedestal manicure workstation with gravity and forced air fed intake grid in a central work surface, for reducing the level of manicure by-products in the area.

With reference to FIG. 1, the manicure table 10 is configured as a pedestal desk and is shown in the optional configuration of a double pedestal desk. A left pedestal 12 and a right pedestal 14 are joined by a central, horizontally supported, planar work surface 16 to define a workstation that is located on the work surface 16 at an off-pedestal position. One or both of the two pedestals are adapted to contain supplies for performing manicure and to contain equipment for removing debris, toxins, and odor. Either or both pedestals may be selected to house functional equipment. As an example, the left pedestal 12 may include drawers, cabinets, or a combination of them for holding manicure supplies. A top element of the left pedestal may be a drawer 18, while a bottom element of the left pedestal may be a cabinet 20, with both drawer and cabinet configured to hold supplies.

As a further portion of the example, the right pedestal 14 may appear to have the same structural elements due to being covered by apparently identical drawer front 22 and cabinet door 24. However, the right pedestal is configured to contain and support functional equipment for removing debris, toxins, and odors. The central work surface 16 provides an off-pedestal, working area for a manicurist. The two side pedestals are shown to extend higher than the level of work surface 16, but this height is optional. A single, horizontal work surface 16 may extend for the full width of the manicure table 10, if desired.

Figure 2:
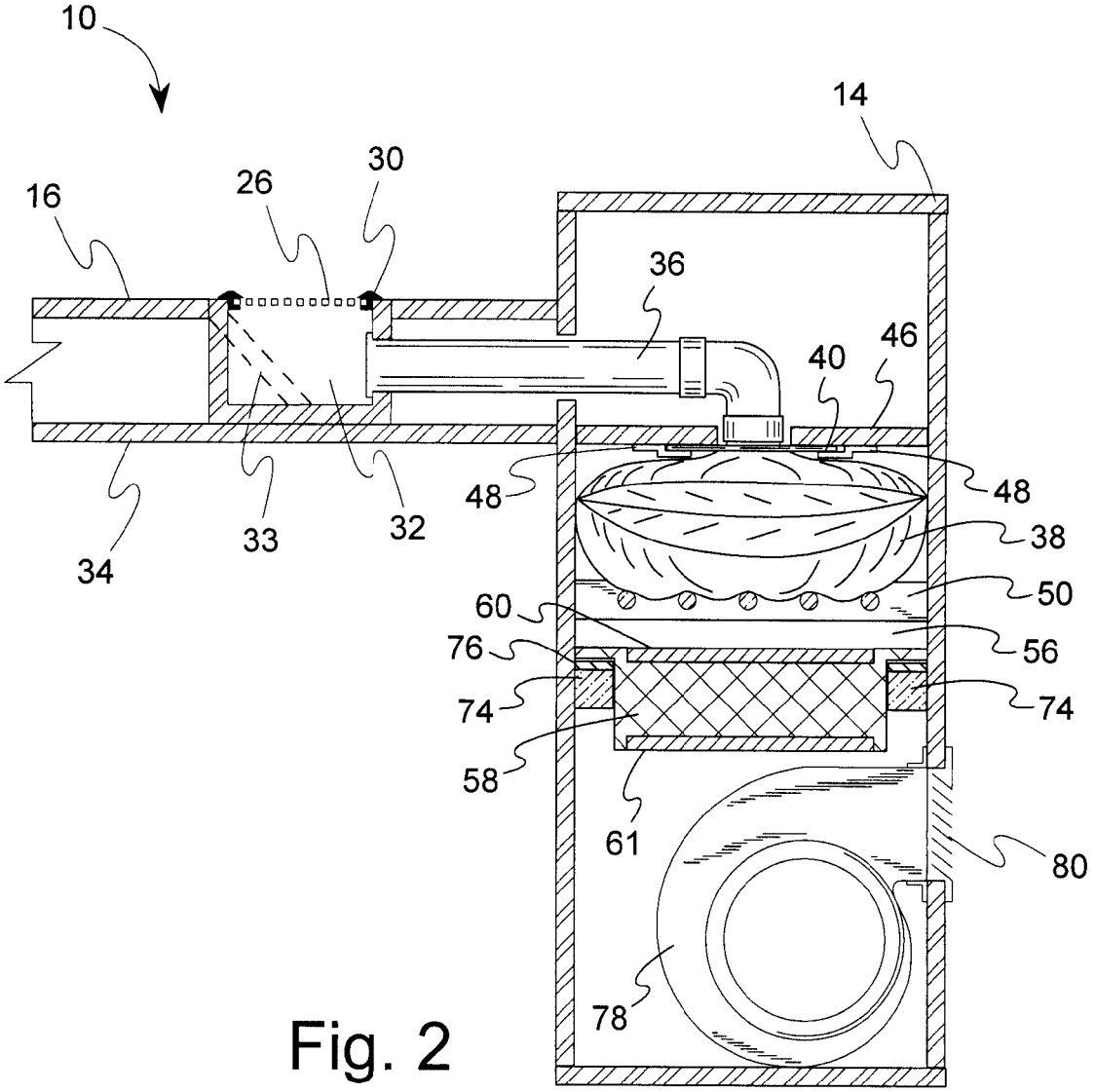
FIG. 2 is a front elevational view of the center and right portions of the manicure workstation of FIG. 1, with the center and right portions shown in vertical cross-section, revealing the components within each.

Work surface 16 defines a first, preselected, horizontal, ventilated intake grid 26 that is a portion of the system for removing debris, toxins, and odors. Conventionally, grids in this position or similar positions are used on manicure tables for receiving debris by gravity. Surface intake grid 26 is a gravity-assisted, downdraft air inlet for intake of air, debris, and fumes from manicure operations. While other areas of the work surface 16 are multi-functional, surface grid 26 defines the specific work area for the manicurist to perform each task that might generate debris, such as debris from filing, trimming, and buffing finger nails. The surface grid 26 also is the defined work area for applying solvent-based chemicals, such as cuticle creams, nail polish remover and nail polish. The grid defines an array of openings that allow air to pass through. The size of the openings is sufficient to prevent passage of certain small objects, such as manicure tools and supplies. The surface grid 26 may be removably mounted to work surface 16 so as to be readily cleaned or replaced. For example, the surface grid 26 may rest on the side edges or shoulders 28 of a cutout in the top surface 16. The surface 16 may be recessed at edges 28 so that the surface grid lies in the same plane as surface 16. A transitional member such as a frame 30 may bridge the boundary between the grid 26 and surface 16 to create a protective guard for the hands of the manicurist and customer against any roughness at the interface of the two elements 16, 26. As shown in FIG. 2, frame 30 may support surface grid 26 within depending side walls for ease of lifting or reinstalling the grid. For this purpose, the frame side walls provide centrally extending flanges or lips at the bottom edge of the frame for supporting the grid.

With reference to FIG. 2, a collection chamber 32 lies below grid 26. Conventionally, collection chambers are used below surface grids to capture debris that may fall through the grid by gravity. However, this collection chamber 32 communicates with a source for exhausting air to serve as a vacuum box, which draws downdraft air through first grid 26. The chamber 32 also receives debris by gravity or vacuum draw that passes through the grid 26. Chamber 32 also directs and concentrates air flow received through grid 26. The central area of table 10 that carries work surface 16 also houses chamber 32. For this purpose, the central area between the two pedestals is of sufficient depth to receive chamber 32. The length and width of chamber 32 may be defined by side walls that establish similar dimensions to those of surface grid 26 so that the chamber will be swept of debris by airflow and by hand cleaning, as required. The chamber may be configured as a flow director and flow concentrator, by having one or more side walls 33 oriented to direct air flow and debris toward an opposed, air flow exiting side of the chamber. The central area of table 10 may be defined by both a top wall 16 and a bottom wall 34 so that chamber 32 is defined or contained between the top and bottom wall members 16, 34. Bottom wall 34 can assist in holding chamber 32 in place below wall 16 and act as a guard that prevents the chamber and other components from being bumped or displaced by the manicurist or customer.

Figure 3:
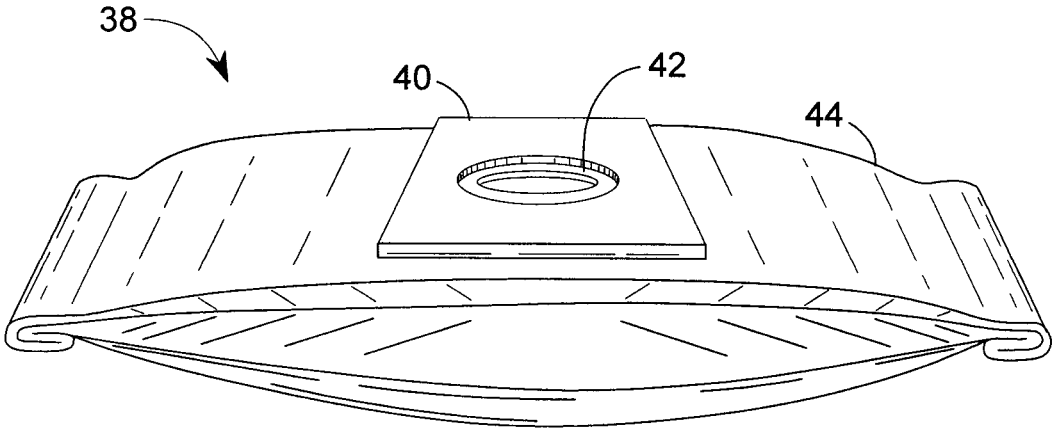
FIG. 3 is a front top isometric view of a suspended, modular solids collection filter bag, showing the interface of the bag to an air duct system within the workstation.

An air duct 36, which may be formed of plastic pipe, is an air flow velocity accelerator and is coordinated in size with an available volume of flow to establish a desired air flow rate. The duct is composed of an inlet end and a discharge end, with a shank portion between the two ends. The duct 36 communicates with chamber 32 to remove debris from the chamber 32 and to deliver the debris to a filter 38 in pedestal 14. Suitable types of filter 38 include both a flat panel filter and a vacuum bag filter 38 to collect fine particles. Where the chamber 32 is configured as a flow director with a convergence, such as created by optional inclined wall 33, the duct communicates with the chamber from a side opposite angled wall 33. The duct 36 crosses from the central area of table 10 into the right pedestal 14, where it connects the chamber 32 to the interior volume of pedestal 14, where the flow will be drawn through fine particle collector filter 38, which is located in the pedestal. The inlet end of the suction pipe 36 is secured to a side of the collection chamber 32 to prevent accidental dislodging. From the secured intake end, the shank of suction pipe 36 extends laterally or horizontally from the central area of table 10 to a top volume of the right pedestal, which is approximately defined as the area behind drawer front 22 and above a separation wall 46 in the pedestal.

Where filter 38 is a filter bag, the separation wall 46 serves as a mounting location to carry the filter bag 38 and may have the additional function of partitioning the pedestal volume into an upper area and a lower area. The separation wall may be at approximately the same height as bottom wall 34 of the central work area. The shank of duct 36 may follow or rest upon the plane of bottom wall 34 and separation wall 46. The configuration of duct 36 includes all necessary bends to reach the pedestal area below separation wall 46. A discharge end of the duct 36 may extend below the separation wall and enter into a particle collector bag 38. When the duct 36 is formed of plastic pipe, the pipe may be PVC pipe of preselected diameter. Any necessary bends or fittings may be selected from the commercial array of such fittings that is readily available from commercial sources.

Where the filter 38 is a collector bag, the discharge end of duct 36 is routed to a suitable position to be engaged by collector bag 38. Separation wall 46 is configured with a suitable duct passage to allow the discharge end of the duct 36 to enter the lower volume of the pedestal. The volume of the pedestal, particularly below separation wall 46, functions as an air flow decelerator, where the degree of deceleration is proportional to the cross-sectional area. As best shown in FIG. 3, the bag 38 defines an intake aperture that is sized to mate with the discharge end of pipe 36 below the separation wall 46. At the intake aperture of the bag, the bag is joined to a hanger plate 40 that defines the bag aperture and carries an elastic collar or seal 42, which encircles the periphery of the aperture. Seal 42 is sized such that, when the aperture of a filter bag 38 is connected to the discharge end portion of the duct 36, the elastic seal 42 sealingly engages the outer wall of the duct.

The body 44 of a filter bag 38 is formed of air permeable sheet material that captures the dust and fine particles that are generated in the manicure process. The bag body 44 is of predetermined size, relative to the width and length of the pedestal 14, such that when expanded for use, it is approximately the same length and width as the interior of the pedestal. As shown in the drawing, the hanger plate 40 preferably is located on the top of the sealed bag 38 so that suction pipe 36 enters the sealed bag with straight down orientation, thus ensuring robust performance such that debris captured in particle collector 38 will accumulate at the bottom of the sealed bag and not block the entry, prematurely.

In the embodiment of FIG. 2, the duct passage in the separation wall 46 is positioned to coordinate with the geometry of the bag 38. Thus, the duct passage in wall 46 is suitably positioned to place the discharge end of suction pipe 36 at a position to enter the mouth of bag 38. The separation wall 46 provides support for hanging bag 38 while engaged on pipe 36. The bottom face of separation wall 46 carries a pair of brackets 48 in opposed lateral positions with respect to the downwardly protruding discharge end of air duct 36. The brackets 48 are positioned on wall 46 to position the mouth of bag 38 at the duct passage in wall 46. The brackets establish receiver slots that laterally face the duct 36. The hanger plate 40 and the brackets 48 are sized for the hanger plate 40 to fit into the receiver slots to hang the bag 38 from the separation wall 46 while engaged with the suction pipe 36.

The hanger plate 40 is formed from planar sheet material having sufficient strength and rigidity to suspend the sealed bag from brackets 48. Optionally, the hanger plate can be positioned to assist in sealing any gap between the suction pipe 36 and the duct passage through the separation wall 46. The separation wall, itself, may serve as a first air seal in the pedestal 14, preventing air flow from above the wall 46 from being drawn into the volume below the wall 46 other than through duct 36. The hanger plate 40 of an installed filter bag 38 in brackets 48 may serve as an auxiliary or second air seal by sealing gaps, if any, between duct 36 and the separation wall 46. Suspending a filter bag 38 from brackets 48 allows the sealed bag to expand downwardly under the draw of vacuum in pedestal 14. While other orientations may be used, a downward expansion from a top suspension point provides the best filtration and utilization of the full sealed bag to pass air flow and capture debris without clogging.

Figure 4:
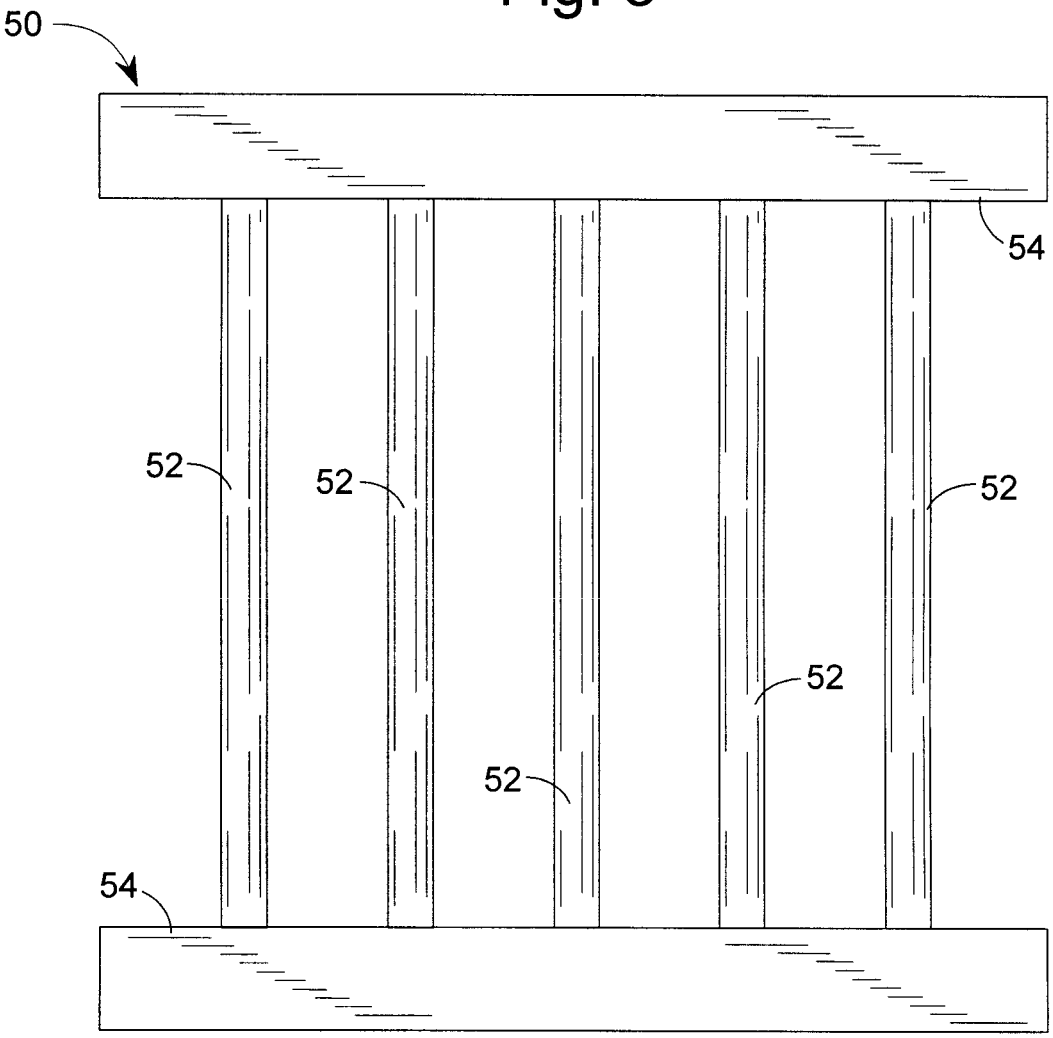
FIG. 4 is a top plan view of a grid for spreading a suspended filter bag.

With reference to FIGS. 2 and 4, a second grid 50 serves as a spreader and bottom support that is located below the particle collector bag 38, at a height in right pedestal where the bottom support 50 will limit the downward expansion of the particle collector 38 when in use under vacuum draw. The predetermined size of the particle collector bag is such that the bag spreader 50 is spaced below the separation wall by a sufficient distance to cause the particle collector bag to spread, in use, to a maximum width that reaches the side walls of the pedestal. The bottom support 50 provides multiple functional advantages. First, it helps to spread the particle collector into expanded configuration that extends substantially from side-to-side and front-to-back of pedestal 14. Second, in use, it helps prevent the particle collector from being pulled down and off the suction pipe. Third, it allows air flow to pass across the bottom support 50 with little restriction. A bottom support 50 can be formed of perforated sheet material or can be formed of a small number of rods 52, such as five rods, held between union plates 54. In the illustrated embodiment, the rods are wood dowels arranged in even spacing across the width or length of the pedestal 14.

The bottom support 50 is spaced sufficiently below particle collector bag 38 to allow the particle collector bag to be removed from pedestal 14 for replacement, when necessary. The hanger plate 40 has sufficient flexibility that it can be temporarily flexed to pass under the end of suction pipe 36 when inserted into or withdrawn from brackets 48, such as to install or remove the particle collector 38.

With further reference to FIG. 2, the pedestal volume 56 below the bottom support grid 50 is a vacuum equalization chamber, which is defined in height by the gap located between the bottom of support grid 50 and the top of an underlying filter housing 58. The equalization chamber is defined in length and width by the interior length and width of pedestal 14. The chamber 56 equalizes draw on particle collector 38 so that restricted flow or channeling below the particle collector does not apply undue suction to a limited area of the particle collector 38. The vacuum equalization chamber is particularly useful when a thick, loose filter media bed underlies the particle collector, as a bed of loose filter media can channelize air flow.

Figure 5:
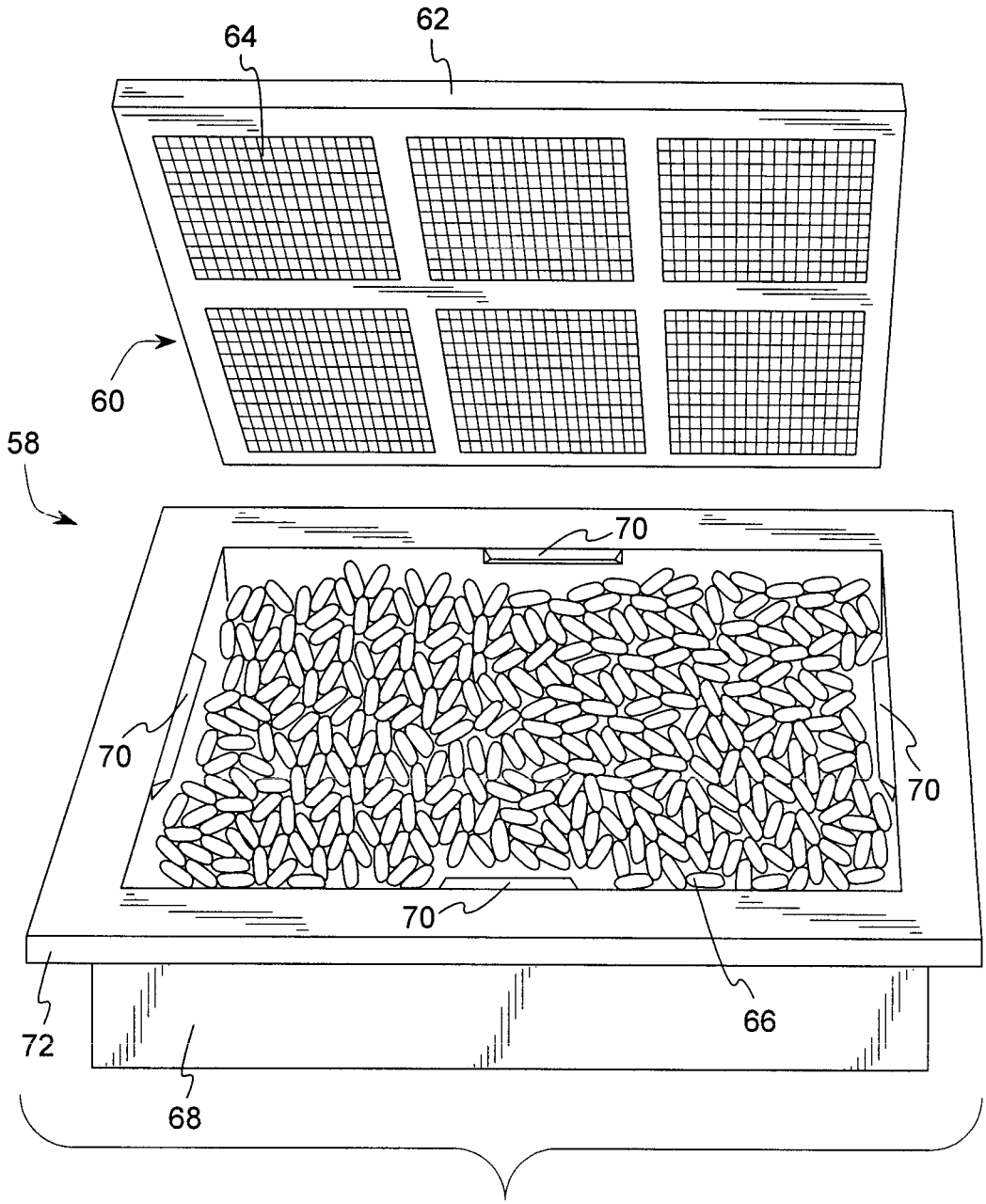
FIG. 5 is a perspective view of a carbon filter and housing. fan or blower that draws air flow from the intake grid.

With reference to FIGS. 2 and 5, filter housing 58 underlies equalization chamber 56 and extends across substantially the entire width and length of pedestal 14 so that all vertical air flow must pass through this housing. Top and bottom major faces of housing 58 are formed of containment grids 60, 61 that are perforated to permit air flow through filter media contained in housing 58. As an example, FIG. 5 shows a top grid 60 formed of a top frame 62 that carries a top retaining screen 64. The mesh size of screen 64 is finer than a preselected grain size of the filter media 66 contained in housing 58. The bed of filter media 66 is selected to function as an odor filter. A suitable choice for filter media in the odor filter is a bed of activated carbon granules. The bed of filter media is loose laid and has substantial thickness, such as one inch or more.

A filter shell or housing frame 68 laterally contains the filter media 66. The lower containment grid 61, schematically shown in FIG. 2, is formed of a screen similar to top screen 64 and is directly attached to or formed integrally with the lower edge of the housing frame 68, in what may be considered to be a permanent attachment. The top containment grid 60 differs from the bottom grid 61 in that it is attachable and removable from the top of filter housing frame 68 to allow access for periodic replacement of the media in filter bed 66. The upper containment grid 60 may be attached to the frame 68 by one or more releasable fasteners. Examples of such fasteners include the illustrated snap flanges 70 that engage the edges of grid 60, or screws can serve equivalently.

Figure 6:
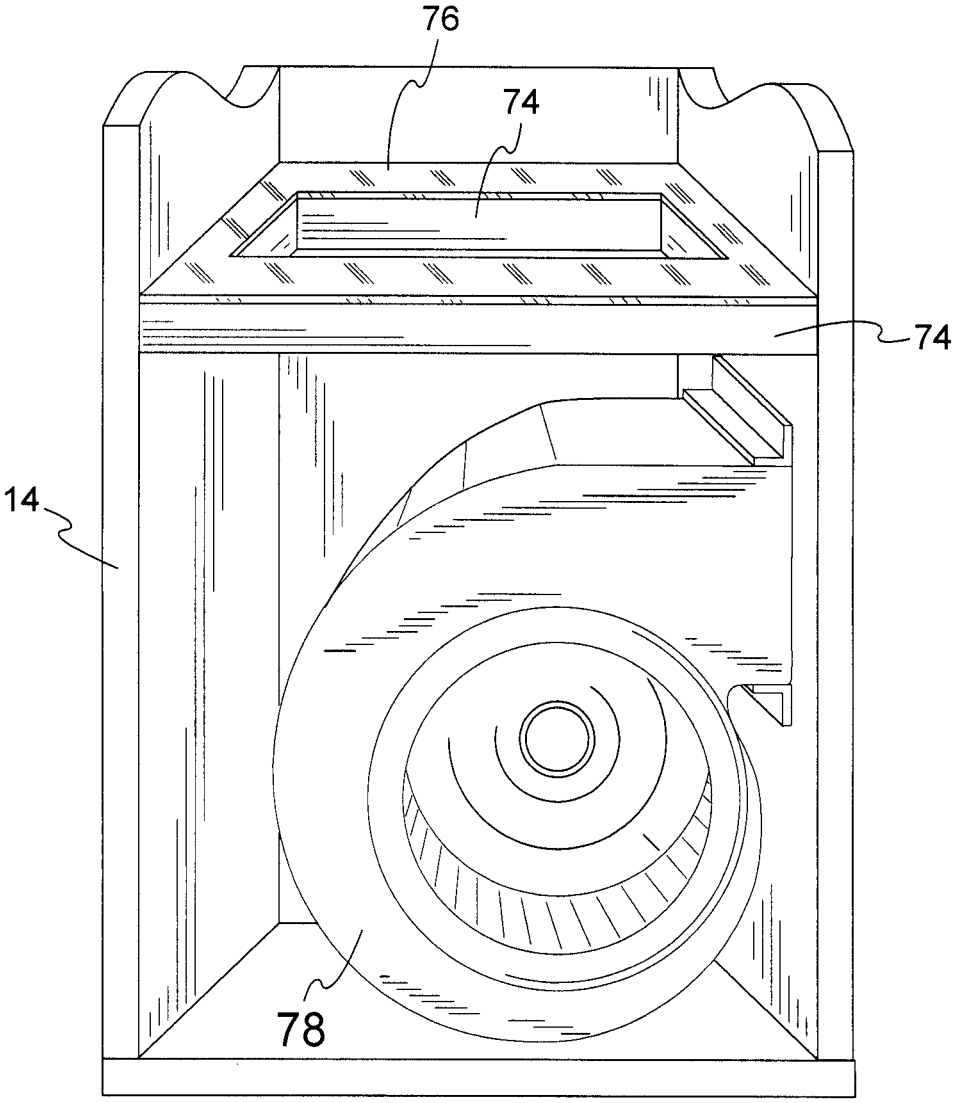
FIG. 6 is a front, fragmentary, perspective view of an edge support and fan in the lower portion of a pedestal.

Suitable interacting structures support the filter housing at a selected height or location in the pedestal 14. As a general example, a peripherally outward extending lip of the filter housing may be supported on a peripherally inward extending support carried on the interior walls of the pedestal. As a specific example shown in FIGS. 2, 5 and 6, a top edge of housing 68 defines a peripheral lip 72 that extends laterally outwardly from the housing shell 68. As best seen in FIG. 6, peripheral edge support bars 74 are fastened to inside faces of pedestal 14 at a height suitable for supporting the filter 58 resting lip 72 on bars 74. A plurality of edge support bars 74 may form a closed geometric figure, such as a rectangle, that defines a central opening sized to receive filter shell 68; or the geometric figure may be open on its front edge, such that the filter shell can be inserted from the front. An air seal is located between the filter housing and the pedestal or filter support. In a typical arrangement, the seal is located between the peripheral lip 72 and air seal 76. Strips of sealing material may be attached to either or both the lip and the support bar. When the lip is supported on peripheral bar 74, the seal establishes an air tight fit, such that substantially all air flow must pass through the filter bed 66. The top face or other contact edge of support 74 may carry the resilient sealing material 76 and constitutes a third air seal in the pedestal 14. In some arrangements, the pedestal door 24 may serve as an element of the seal and, accordingly, an air seal may be employed in a variety of locations, such as between the pedestal box and the door 24 or between the filter housing and the door 24, or at any location where a seal is useful to control air flow. The filter bed is effective to remove many chemical vapors from the air stream.

The odor filter, its mounting in pedestal 14, and various sealing arrangements have been described in detail. The same or similar structural features and relationships are suitable for supporting a panel-style particle filter in place of the filter bag 38, previously described. Thus, a substitute particle filter may be configured as a flat panel, configured similarly to odor filter 58, or otherwise configured to be sealed across pedestal 14 in place of filter bag 38. Any configuration of particle filter may be used in an arrangement such that it receives the air flow from duct 36. For example, a flat panel particle filter may be supported on bottom support grid 50. Sealing strips may be used between the flat panel particle filter and the grid 50 or pedestal walls or pedestal door, as previously suggested. If the filter bag 38 is replaced by a non-bag style filter, the duct 36 should be sealed against its passageway through the workstation in order to maintain efficiency in operation. As an example, the previously described hanger plate 40 and its elastic collar 42 may be applied to the duct at the separation wall, even with elimination of the remainder of the filter bag 38, to maintain efficient suction through duct 36.

In a further modification, the described tubular duct 36 may be replaced by using sealed chambers within the manicure table. For example, if tubular duct 36 were eliminated, the passageway formerly occupied by the tubular duct would continue to function as its own duct. The air would be drawn through the opening in the separation plate and into the filter bag 38 or through any other particle filter.

Finally, with reference to FIGS. 2 and 6, near the bottom of pedestal 14 is air blower 78, oriented to draw air from within pedestal 14 and expel the air through exhaust grid 80, where the air returns to the indoors environment where the manicure table 10 is located. Air blower 78 establishes a rate of air flow that is translated into local velocities by the size of inlet grid 26, air duct 36, and pedestal 14. A suitable air blower is Dayton model 1TDR9, which according to published specifications can maintain air flow ranging from 463 CFM to 250 CFM over static pressure ranging from 0 to 0.4 inches. The manufacturer for such a blower is Dayton Electric Mfg. Co., Niles, Ill. The outside wall of right pedestal 14 carries directional grid 80 for exhausting the air stream that is taken in at grid 26. The right pedestal 14 or any other part of the table 10 may carry switch 82, FIG. 1, for controlling electrical power to blower 78. The switch may be a single throw switch, speed control switch, or a momentary actuation switch.

As described, the manicure table 10 has a robust air cleaning system that establishes an air flow pathway from the inlet grid 26 through exhaust grid 80, using table geometry as a substantial means of velocity regulation. The inlet and exhaust grids may be similar in size, which results in similar rates of inflow and outflow at the opposite ends of the flow pathway. Each of grids 26 and 80 may be about one square foot in area. Between the grids 26 and 80, the pedestal 14 is sealed by such features as door 24 and drawer front 22. The flow path between the inlet and outlet grids is through collection chamber 32, duct 36, particle filter 38, spreader grid 50, equalization chamber 56, upper containment grid 60, filter bed 66, the lower containment grid, and air blower 78.

Flow rates at various points in the flow path are inversely proportional to the cross-sectional area of the flow path. In order to create a robust cleaning system, air stream velocity is varied in different operating zones to establish velocity envelopes of the cleaning system according to functional benefit. There are three operating zones producing three velocity envelopes in the manicure station 10. The first is the rate setting zone, which provides a sweep of air over the work area. The air velocity envelope at work surface 16, and particularly at inlet grid 26, is effective in removing debris and fumes while the manicurist is working on the customer's nails. The flow rate at grid 26 is relatively low, in order to present no distraction to the manicure work being done above the first grid. Often the inlet flow rate will be similar to the outlet flow rate at exhaust grid 80, by virtue of the inlet grid and outlet grid being of similar sizes. The second zone has a velocity envelope sufficient for debris removal through duct 36. Relatively higher velocity is desired to establish a flow pattern within collection chamber 32 to clear the collection chamber of debris. Target flow in the velocity envelope of duct 36 can be in the range from five to fifty times the flow rate at inlet grid 26. The third zone has a velocity envelope suitable for processing flow through pedestal-sized components, such as the particle collector 38 and media bed 66. This zone is located below separator wall 46 and the envelope is determined by the cross-sectional area of the pedestal 14. Air velocity in the third zone should be the lowest of the three envelopes, such as from one-half to one eighth of the velocity in the first envelope.

The following table shows two examples of relative flow velocity in the three operating zones based on two different sizes of inlet and outlet grids. The two examples of the first zone consider inlet grids and outlet grids that are 12×12 inches and 6×12 inches. The inlet grids and outlet grids are considered to be the same size so that neither alters flow rate through the other. For each of the two examples of the first envelope, the second envelope considers ducts of three sizes: two inch, three inch, and four inch. For each of the two examples of the first envelope, examples of the third envelope consider pedestals of four sizes: 12×30, 12×36, 18×30, and 18×36 inches.

| Example 1 | Relative Velocity | Example 2 | Relative Velocity |
|---|---|---|---|
| Inlet/Outlet 12 × 12 | 1 | Inlet/Outlet 6 × 12 | 1 |
| Air Duct 2 inch | 45.7 | Air Duct 2 inch | 22.9 |
| Air Duct 3 inch | 20 | Air Duct 3 inch | 10.0 |
| Air Duct 4 inch | 11.4 | Air Duct 4 inch | 5.7 |
| Pedestal 12 × 30 | 0.43 | Pedestal 12 × 30 | 0.21 |
| Pedestal 12 × 36 | 0.29 | Pedestal 12 × 36 | 0.14 |
| Pedestal 18 × 30 | 0.29 | Pedestal 18 × 30 | 0.14 |
| Pedestal 18 × 36 | 0.29 | Pedestal 18 × 36 | 0.14 |

As shown in the two examples, the inlet/outlet flow was set to unity and used as the base figure to establish the other relative velocities. In the air ducts, flow velocity was a large multiple of inlet/outlet flow velocity, with velocity factors ranging from 5.7 to 45.7 and typically being about a quantum increase over velocity in the first envelope. In the pedestal, flow velocity dropped to a minor fraction of flow velocity in the first envelope, with velocity factors ranging from 0.14 to 0.43. Typical velocity in the pedestal is about one-fifth to one-quarter of the velocity in the first envelope.

In operation of the manicure table 10, spreader grid 50 assists particle filter 38 to expand to the side walls of the pedestal 14. Air flow entering particle bag 38 is moving at about twenty-five percent or less of the intake rate at grid 26. Thus, air flow through both the particle filter 38 and the odor filter bed 66 are moving slowly in comparison to inflow and outflow rates. The air stream has low impact on the particle filter 38, which enhances capture rates. The air has prolonged residence time in the odor filter bed, which enhances odor removal. The expelled air has been purified of both particles and odors. It should be appreciated that the given flow rates are examples based on typical dimensions of grids, ducts, and pedestals. Different dimensions can be employed. However, the exemplary flow rates will continue to describe the performance of the robust air cleaning system at least in approximations, as suggested by the examples.

The manicure table 10 solves the problem of odor and debris in a manicure salon. It employs effective components in a suction system, where air intake is through the primary work surface. The air exhaust is directed away from the manicure table so that the manicurist and customer are free from the exhaust stream. The two elements that remove undesired components from the air stream are the particle collector and the odor filter. These two elements operate in an environment with an extremely low velocity air stream to enhance performance. In addition, these two elements are particularly easy to replace when necessary. They are housed in the pedestal with a cover such as door 24 on one side that can be substantially entirely opened for access to the elements requiring service. Similarly, the open side allows ready access to the blower 78 or to any other part of the blower system that may require attention. During use, the pedestal is sealed by appropriate covers such as door 24 over the open side. Thus, the manicure table 10 solves a problem in the manicure industry by providing robust components that are simple to service or replace.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A manicure table employing table geometry to create high efficiency in debris and odor removal, having a substantially vertical support pedestal and a substantially horizontal manicure work surface offset from over-pedestal position, integrated with a robust air cleaning system that operates on air flowing in a flow path, comprising:

an air inlet grid of first preselected cross-sectional area, located on said manicure work surface and defining a work area thereon;

a collection chamber of second preselected cross-sectional area located below the air inlet grid and juxtaposed thereto, communicating through said air inlet grid to receive air flow from the work area;

an air duct of third preselected cross-sectional area having an inlet end and a discharge end, wherein said inlet end communicates with said collection chamber to receive air flow from the collection chamber, and wherein said air duct includes a shank portion that leads laterally from said inlet end to said pedestal, and wherein said discharge end communicates with the interior of the pedestal;

a particle filter located in the pedestal below the discharge end of the air duct and arranged to receive air flow from the discharge end of the air duct;

an odor filter located in the pedestal below the discharge end of the air duct and arranged to receive and filter air flow from the discharge end of the air duct;

an exhaust blower located below said particle filter and odor filter, in use, establishing drawn air flow through the air inlet grid, collection chamber, air duct, particle filter, and odor filter of said air path and exhausting the air flow through an exhaust grid in a pedestal side wall;

wherein, said first preselected cross-sectional area and said second preselected cross-sectional area each are larger than said third preselected cross-sectional area such that resulting air velocity through the air inlet grid and collection chamber is less than air velocity through the air duct, establishing relatively high air flow velocity through said air duct to produce a high rate of debris removal from the collection chamber and establishing relatively low air flow velocity at the work area.

2. The manicure table of claim 1, further comprising:

a separation wall positioned across the pedestal, below the level of said shank portion of the air duct and above said particle filter, providing a duct passage through which said discharge end of the air duct feeds air flow into said particle filter, and wherein the flow path below the separation wall is laterally expanded to the inner side walls of the pedestal.

3. The manicure table of claim 2, wherein:

said particle filter is a collector bag and is attached to the separation wall at the periphery of said duct passage.

4. The manicure table of claim 3, wherein:

said support pedestal is defined by front, rear, and side walls establishing a fourth preselected horizontal cross-sectional area;

said collector bag is of predetermined size sufficient to expand laterally to the distance between sides of the pedestal and longitudinally to the distance between the front and rear of the pedestal, and further comprising:

a combined vertical support and bag spreader located below said collector bag by a suitable distance to carry the collector bag and, when said exhaust blower is in use, to widen the collector bag to extend between the sides and between the front and rear of the pedestal.

5. The manicure table of claim 1, wherein:

said inlet end of said air duct is connected to said collection chamber at a first side thereof;

a second side of the collection chamber, opposite from said first side, is configured to direct air flow and debris toward the first side of the chamber and toward said inlet end of the air duct.

6. The manicure table of claim 5, wherein:

said second side of the collection chamber is oriented to create a flow convergence toward said inlet end of the air duct.

7. The manicure table of claim 1, wherein said relatively high air flow velocity through said air duct is at least a quantum greater than said relatively low air flow velocity at the work area.

8. A manicure table having a substantially vertical support pedestal and a substantially horizontal manicure work surface offset from over-pedestal position, with an air cleaning system establishing and serving a work area on said work surface, comprising:

an air inlet grid mounted at an opening in said work surface and defining said work area;

a collection chamber mounted below the air inlet grid, juxtaposed at its top to the air inlet grid and sized similarly to the air inlet grid such that down flowing air from the air inlet grid passes into the collection chamber;

an air duct having an inlet end, a shank portion, and a discharge end, with said inlet end connected to said collection chamber, said shank portion of the air duct extending from the inlet end to the pedestal, and said discharge end extending into the interior of the pedestal;

a particle filter located in the pedestal below the discharge end of the air duct and arranged, in use, to receive and filter air flow from the discharge end of the air duct;

an odor filter located in the pedestal below said particle filter and arranged, in use, to receive and filter air flow from the particle filter; and an exhaust blower located in the pedestal below said particle filter and odor filter, in use drawing air flow through the air inlet grid, collection chamber, air duct, particle filter, and odor filter and exhausting the air flow from the pedestal;

wherein the inlet grid and collection chamber are sized, relative to the air duct, to establish equivalent air flow volume at substantially lower velocity through the inlet grid and collection chamber.

9. A manicure table having a substantially vertical support pedestal and a substantially horizontal manicure work surface offset from over-pedestal position, with an air cleaning system establishing and serving a work area on said work surface, comprising:

an air inlet grid mounted at an opening in said work surface, defining said work area, and establishing a first element in an air flow path;

a collection chamber mounted below the inlet grid, juxtaposed at its top to the inlet grid, sized similarly to the inlet grid such that downflowing air from the inlet grid passes into the collection chamber, and establishing a second element in an air flow path;

an air duct having an inlet end, a shank portion, and a discharge end, with said inlet end connected to said collection chamber, said shank portion of the air duct extending from the inlet end to the pedestal, and said discharge end located in the interior of the pedestal, and establishing a third element in an air flow path;

wherein said air flow path established by said first, second, and third elements is contoured with respect to the relative cross-sectional areas of the air inlet grid, the collection chamber, and the air duct to establish a relatively lower air flow velocity through the air inlet grid and collection chamber and to establish relatively higher air flow velocity through the air duct;

a particle filter located in the pedestal below the discharge end of the air duct and arranged, in use, to receive and filter air flow from the discharge end of the air duct;

an odor filter located in the pedestal below the particle filter and arranged, in use, to receive and filter air flow from the particle filter; and an exhaust blower located in the pedestal below said particle filter and odor filter, in use drawing air flow sequentially through the air inlet grid, collection chamber, air duct, particle filter, and odor filter and exhausting the air flow from the pedestal.

10. The manicure table of claim 8, wherein:

said pedestal establishes a fourth element in an air flow path; and said air flow path is contoured with respect to said relative cross-sectional areas of said air duct and pedestal to establish, in use, relatively high air flow velocity through said air duct to produce a high rate of debris removal from the collection chamber and to establish relatively low air flow velocity in said pedestal through the particle filter and odor filter to produce a high removal rate of particles and odors therein.

11. The manicure table of claim 9, wherein said flow path is contoured to produce at least a quantum difference between said relatively higher air flow velocity through said air duct and said relatively low air flow velocity through said air inlet grid and collection chamber.

* * * * *